United States Patent [19]

Schneckenberger

[11] Patent Number: 4,598,650

[45] Date of Patent: Jul. 8, 1986

[54] FLUID AND SOLID WASTE INCINERATION SYSTEM

[76] Inventor: Marc G. Schneckenberger, 7751 S. 72nd East Pl., Tulsa, Okla. 74133

[21] Appl. No.: 789,430

[22] Filed: Oct. 21, 1985

[51] Int. Cl.[4] ..... A47J 36/00; A47J 36/24

[52] U.S. Cl. ..... 110/246; 110/235; 110/238; 110/346

[58] Field of Search ..... 110/238, 246, 235, 237, 110/346

[56] References Cited

U.S. PATENT DOCUMENTS 4,398,475 8/1983 McKiel, Jr. ..... 110/346

4,511,549 4/1985 Diemer et al. ..... 110/238 X 4,575,336 3/1986 Mudd et al. ..... 110/238 X

*Primary Examiner*—Edward G. Favors

[57] ABSTRACT

A system is disclosed for incinerating fluid (liquid and/or gas) and solid waste including a first, second, and third combustion zones of successively larger interior volumes. Liquid wastes are introduced into the first combustion zone and solid wastes are introduced into the third combustion zone, whereby solid wastes are heated from conduction and/or convection by the first and/or the second combustion zone prior to the solid wastes being introduced into the third combustion zone.

11 Claims, 4 Drawing Figures

FLUID AND SOLID WASTE INCINERATION SYSTEM

FIELD OF THE INVENTION

The present invention relates to a waste incineration system and, more particularly, to such a system capable of incinerating fluid (liquids and gasses) and/or solid hazardous waste.

DESCRIPTION OF THE PRIOR ART

Devices used to incinerate waste materials have been developed for many years; however, in recent years the concerns for environmental protection have spurred the development of hazardous waste incinerators.

These prior art hazardous waste incinerators usually burn at high temperatures liquid or gaseous waste products or solid or particulate waste products. Further, these incinerators use additional fuel, such as natural gas, oil, or coal, to complete the incineration of the wastes. One prior art incineration system that uses liquid or sludge-like wastes as the sole fuel for incineration is disclosed in U.S. Pat. No. 4,475,466, which is incorporated herein by reference. Nowhere is it disclosed or suggested within U.S. '466 to incinerate solid material, such as that from a sanitary landfill or from a chemical dump.

Other prior art hazardous waste incinerators that have a feed of solid material use additional fuel, such as natural gas, to complete the incineration of the wastes, which obviously is expensive and wasteful. Another problem with such solid waste incinerators is that the rotary kiln, usually utilized, is operating at temperatures of about 1500° or above when ambient temperature solid waste is introduced. The contact of the relatively "cold" solid waste with the "hot" refractory lining often causes cracking and failure of the refractory lining in and around the entrance area. Obviously, a way of reducing the failure of the refractory material is needed. Nowhere is it disclosed or suggested in any known prior art incinerator reference to preheat the solid waste material to prevent the failure of the kiln's refractory material and to aid in the cumbustion process.

SUMMARY OF THE INVENTION

The present invention has been designed to overcome the foregoing deficiencies and meet the above described needs. A system is provided for incinerating liquid, gaseous, and/or solid wastes. A first combustion zone is provided and has an inlet for the introduction of liquid or gaseous wastes and includes an outlet that communicates with a second combustion zone. The second combustion zone is of a larger interior volume and diameter than the first combustion zone. A third combustion zone is in communication with an outlet of the second combustion zone and is of a larger interior volume and diameter than the second combustion zone. A second inlet is provided in the third combustion zone for the introduction of solid waste, and an outlet is provided for discharge of gaseous and solid products of combustion.

Means are provided for introducing solid waste into the third combustion zone's second inlet. A portion of this introduction means being adapted to heat any solid material therein by conduction and/or convection from the first and/or the second combustion zone.

The present invention has the capability of incinerating gaseous, liquid, and/or solid wastes, particularly hazardous wastes. Also, no additional fuel is required to incinerate the wastes, i.e., the waste feed itself should have sufficient BTU content to fuel the incineration process, once the feed has been blended or prepared.

Further, the present invention also prehdats any solid waste using conduction and/or convection heat from the combustion within the first and second combustion zones to prevent any cracking or premature failure of the refractory lining adjacent the entrance or second inlet of the third combustion zone.

DETAILED DESCRIPTION OF THE PREFERRED EMBODIMENTS

The present invention provides a system for the incineration of liquid, gaseous, and/or solid wastes and comprises the following devices or components:

- a first combustion zone having an inlet for the introduction of liquid and/or gaseous wastes through a burner system and an outlet;
- a second combustion zone of a larger interior volume and diameter than the first combustion zone, the second combustion zone having an inlet for the introduction of emissions from the first combustion zone's outlet and has an outlet;
- a third combustion zone of a larger interior volume and diameter than the second combustion zone, the third combustion zone having a first inlet for the introduction of emissions from the second combustion zone's outlet, a second inlet adjacent the first inlet for the introduction of solid waste; and an outlet opposite from the first and second inlets for discharge of gaseous and solid emissions; and
- means for introducing solid waste through the third combustion zone's second inlet, a portion of this introduction means being adapted to heat any solid waste therein by conduction and/or convection from the first and/or the second combustion zones.

Figure 1:
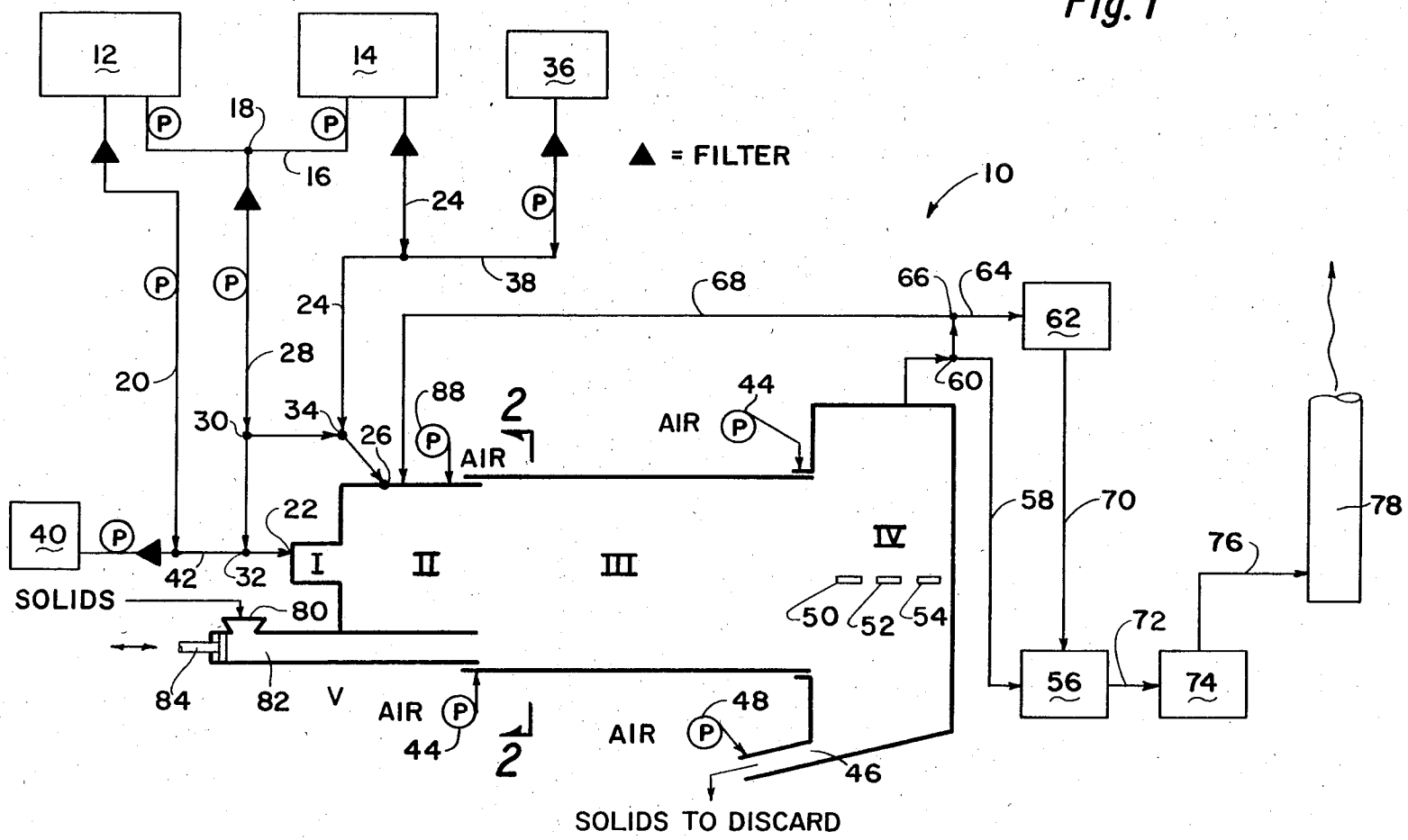
FIG. 1 is a semi-diagramatic elevational view of an incineration system of one embodiment of the present invention.

For a more detailed understanding of the present invention, reference is now made to FIG. 1 where the system of the present invention is indicated by reference numeral 10. At least five major component zones are indicated as follows:

- I is a first combustion zone,
- II is a second combustion zone,
- III is a third combustion zone,
- IV is an optional conditioning or post combustion chamber, and
- V is an introduction zone for solid waste into the third combustion zone.

Tanks 12 and 14 are provided for receiving and storing liquid wastes. The two tanks 12 and 14 are in communication with each other through conduit 16 and three way valve 18. A conduit 20 provides a passage for waste from tank 12 to a burner 22 in a first end of the first combustion zone I. A conduit 24 provides a passage for waste from tank 14 to a nozzle or nozzles 26 in the second combustion zone II. A conduit 28 provides a passage for waste from either or both tanks 12 and 14 to either or burner 22 and nozzle 26 through three way valves 30, 32, and 34.

Gases from the tanks 12 and 14 can be removed and stored in a tank 36, which is in communication through conduits 38, 28, and 24 with either or both burner 22 and nozzle 26. Any such gases can be used alone or can be blended with other gases from other processes. Any additional gas either for incineration or for use as additional fuel can be stored in a tank 40, which is in communication through conduits 42, 28 and 24 with either or both burner 22 and nozzle 26.

The conduits described above can be equipped with filters (shown in FIG. 1 as triangles) to remove any particulate material in the liquid or gaseous wastes that might clog the burner 22 and nozzle 26. Further, the conduits described above are equipped with pumps (shown in FIG. 1 as circles) to cause the liquids and gases to be moved from point to point, as desired, in the system 10.

The burner 22 and nozzle 26 can be of any commercially available design capable of injecting, atomizing, and igniting liquids and/or gases. Some acceptable burner designs are disclosed in U.S. Pat. Nos. 3,174,527; 4,462,318; and 4,475,466. The burner 22 can be situated in any desired position or angle within and with respect to the first combustion zone I. The nozzle 26 can also be so situated, but it is desirable for nozzle 26 to be angled in some manner to create turbulent flow of combustion gases within the second combustion zone II. One such angling can be for nozzle 26 to direct its effluent tangentially to the interior surface of the second combustion zone II.

The first and second combustion zones I and II respectively can be of any suitable configuration and sizing. For ease of assembly, it is preferred that both the first and the second combustion assemblies be tubular, and lined with refractory material. The second combustion zone II acts also as an expansion chamber so the interior volume thereof is preferably larger than the interior volume and diameter of the first combustion zone I.

The third combustion zone III can be any commercially available rotary kiln or a traveling grate kiln. Such kilns are described in U.S. Pat. Nos. 3,169,498; 3,320,908; and 3,513,788. The entrance and exit of the third combustion zone III are provided with suitable positive air pressure seals (not shown) and forced air devices 44, to prevent any partially or uncombusted waste from leaking to the atmosphere.

A post combustion chamber IV is in communication with the outlet of the third combustion zone III and provides a lower tapered trough 46 or chute for the discharge of any solid matter which are by-products of combustion. An additional forced air device 48 is provided adjacent the exit opening of the trough 46 to prevent any partially or uncombusted waste from leaking to the atmosphere. If desired, additional burners 50 can be provided in the post combustion changer IV, as well as injection points for air and water 52 and 54 respectively. The benefits of these additional burners 50 and the injection of air and/or water will be described below.

Fully combusted waste gases exit the upper portion of the post combustion chamber IV and all or a portion thereof can be directed to: a quench tank 56 through conduit 58 and three way valve 60, a boiler 62 through conduit 64 and three way valves 60 and 66, and a nozzle (not shown) in the second combustion zone II through conduit 68 and three way valves 60 and 66. After the hot gases have heated the boiler's 62 liquid, such as water, the gases are passed through conduit 70 to the quench tank 56. The now quenched gases exit the quench tank 56 and pass through a conduit 72 to a suitable gas purification device 74, such as an electrostatic collector, filter collector, or scrubber. The gases then pass through a conduit 76 for discharge through a stack 78 into the atmosphere.

An important feature of the present invention is not only the capability of incinerating liquid and gaseous wastes, but solid waste as well. In the present invention, a solid waste conveyance or introduction mechanism V is provided adjacent, and preferably below, the first and second combustion zones I and II. In this mechanism, solid waste is introduced through an opening, chute, or shredder 80 into a trough, channel, or conduit 82. A screw auger or preferably a plunger 84 is provided to compact the introduced solid waste and to move or push it into the inlet of the third combustion zone III.

Figure 2A:
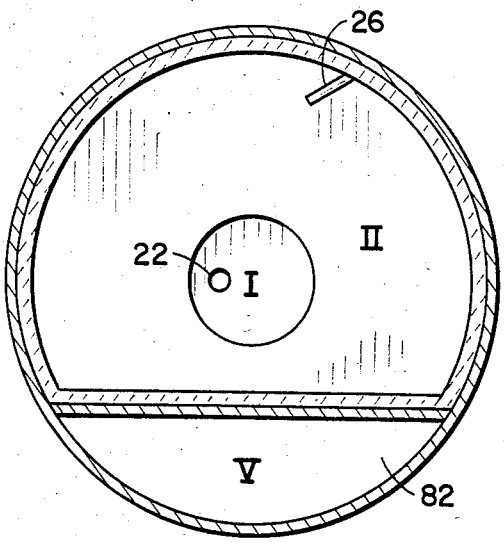
FIG. 2A is a view taken along line 2—2 of FIG. 1.
Figure 2B:
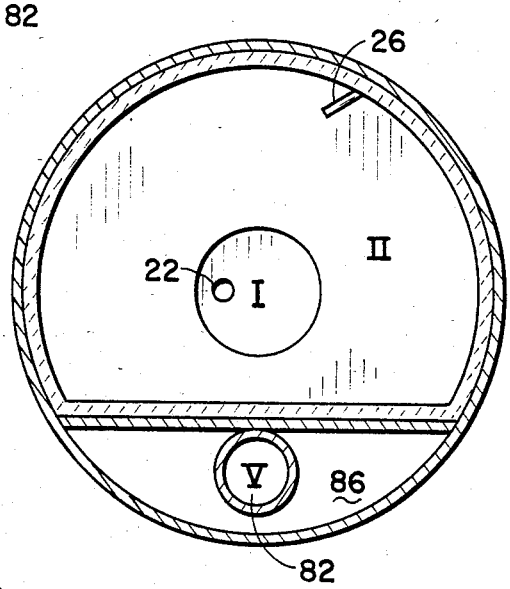
FIG. 2B is a view of an alternate embodiment of the present invention showh by FIG. 2A.
Figure 2C:
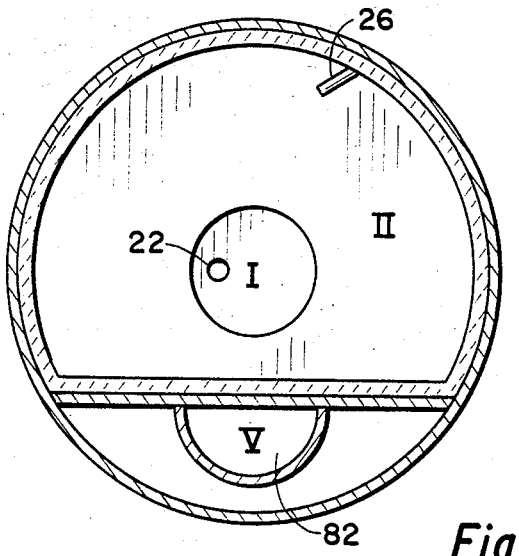
FIG. 2C is a view of an alternate embodiment of the present invention shown by FIGS. 2A or 2B.

As shown in FIG. 2A, the trough 82 is formed by a horizontal baffle or dividing wall that extends across the lower portion of the second combustion zone II, or as shown in FIG. 2B, the trough 82 can be a pipe or conduit held in place by a vertical plate 86.

In the trough, channel, or conduit 82 the solid waste will be preheated by conduction and/or convection, but the solid waste is preferably not heated to combustion temperatures. If a plunger 84 is used, the solid waste will be compressed and compacted so that insufficient oxygen will be present to initiate or sustain combustion while the solid waste is in the zone V. Further, no flames from either the first combustion zone I or the second combustion zone II will contact the solid waste because of the division wall separating the zones I/II from V (shown in FIGS. 2A and 2B) to avoid radiant heat transmission to the solid waste. The temperature of the solid waste is preferably raised to a point so that when the solid waste contacts the refractory material of the third combustion zone III, such as in a rotary kiln, no thermal cracking of the refractory material will take place. Once the solid waste enters the third combustion zone III, the necessary ingredients for combustion, such as oxygen and radiant energy, will be in sufficient quantities to initiate and sustain combustion of the solid waste.

A more detailed description of one embodiment of the present invention will be provided below. In this embodiment, tank 36 can contain hazardous waste gases, as well as product gases removed from tanks 12 and 14. Tank 12 contains high BTU liquid wastes, such as above 4,000 BTU/lb. If necessary, additional conventional fuel can be added to maintain the BTU content above the recommended 4,000 BTU/lb. This liquid waste is pumped through a filter and then into the burner 22 in the first combustion zone I where preliminary combustion occurs. Tank 14 contains lower BTU liquid wastes, such as below 4,000 BTU/lb., which are pumped through a filter and then into the nozzle(s) 26 in the second combustion zone II for preliminary combustion occurrence. If the gases held in tanks 36 and 40 are in excess of about 30 BTU's per standard cubic foot, the gases are pumped to the burner 22, and if the gases are below about 30 BTU's per standard cubic foot, the gases are pumped to the nozzle(s) 26.

The interior of the second combustion zone II in combination with the burner 22 in the first combustion zone I contain the necessary combustion control equipment. What is meant by this is that the incineration of the liquid wastes and/or gaseous wastes are controlled by the throttling of the burners 22 and nozzle(s) 26, the quantity of recycled hot gases through conduit 68, as well as the quantity of additional oxygen provided through forced air pump 88, as is well known to those skilled in the art. These devices to control the combustion and therefore the incineration of the wastes, have either manual controls (not shown) or automatic process controls (not shown), again, as is well known to those skilled in the art.

The burner 22 contains ignition devices to ignite and maintain combustion and the nozzle can contain more than one nozzle for the injection and atomizing of the liquid and/or gaseous wastes. Also, these nozzles can be spaced around the circumference of both the first and the second combustion zones I and II. Also, more than one burner can be provided in each combustion zone, if desired.

The temperature in the first combustion zone I can approach the ionization temperature of the waste(s) being combusted, but in actual implementation of the present invention, the temperature is preferably controlled to be below the ionization temperature, except for a possible hot point of the interior of the flame pattern.

The third combustion zone III has the forced air device 44 that injects air parallel with the flow of combustion gases through the third combustion zone III. This minimizes any creation of additional heat due to air turbulence at the critical location of the seal between the outlet of the second combustion zone II and the inlet of a rotary kiln (third combustion zone III), and the outlet of the third combustion zone III.

The sizing of the components of the present invention is dependent upon providing sufficient temperature and residence time of the wastes to complete the necessary incineration to render the wastes inert. In one implementation of the present invention, the first and second combustion zones I and II are from about three to about ten cubic feet and from about ten to about two hundred cubic feet respectively. The first and second combustion zones I and II are modified with a horizontal refractory floor, division wall, or baffle to provide space for an 8" to 36" high opening or conduit 82 for passing the solid waste adjacent the second combustion zone for preheating and then into the third combustion zone III.

The third combustion zone III is a rotary kiln of about 8–15 feet in diameter and about 30–150 feet in length. The post combustion chamber IV can be any desired shape or size and can be a stationary type burner unit of about 12 feet×12 feet×20 feet to about 50 feet×50 feet×120 feet in size. The lower portion 46 of the post combustion chamber IV preferably of sufficient length to provide some cooling of the particulate slag or solid products of combustion prior to their discarding. Further, the post combustion chamber IV can utilize the burners or nozzles 50, 52 and 54 to provide the necessary additional heat, H, or $O_2$ (in the form of air and/or water injection) to break and prevent reforming of long chain and complex hazardous wastes, such as PCB's.

The sizing and details concerning the quench tank 56, the optional boiler 62, the filter 74, and the stack 78 are dependent upon the particular needs but do not form part of the novelty of the present invention.

If desired, the system of the present invention, i.e., zones I–V can be mounted permanently at a location, formed in component sections of ease of disassembly and moving, or can be truck, trailer or skid mounted.

To better understand the outstanding features of the present invention, a brief listing will be provided below of important features of the present invention. This listing is by no means a listing by rank of importance.

(1) the ability to incinerate to completion (inert state) all types of hazardous waste in liquid, gaseous, or solid form without the need for additional combustion fuel, i.e., the BTU content of the wastes are preferably sufficient for combustion.

(2) the highest heat content waste is burned in combustion zone I to preheat and pass heat downstream to the other zones.

(3) the nozzle(s) 26 are arranged for turbulent mixing of all added compenents and waste within the second combustion zone II to ensure adequate mixing and complete combustion of the waste materials.

(4) the placing of the solid waste adjacent the first and/or second combustion zones I and II allows the solid waste to be preheated without additional heating means before introduction into the third combustion zone III to not only aid in the combustion of the solid waste, but also to prevent any thermal shock to the refactory lining at the entrance of the third combustion zone III.

(5) once introduced, all wastes are sealed within the system, mainly by using forced air devices at any openings or seals between zones to prevent any escape of uncombusted or only partially combusted waste until such wastes have been rendered inert, cooled, and cleaned (scrubber/filter) before discharge through the stack 78 to the atmosphere.

(6) the forced air devices introduce additional oxygen and hydrogen for incineration by passing the air parallel with the flow of gases through the system to prevent unnecessary turbulent heat at its opening into the combustion chambers.

(7) the solid wastes are introduced into a lower part of the third combustion zone III to prevent any falling solid wastes from breaking or chipping the heated refractory lining.

(8) the third combustion zone III provides both adequate residence time and temperature for the degradation of the combustion gases from zone I and II and the solid waste from zone V.

Wherein the present invention has been described with respect to the drawings attached hereto, it should be understood that other and further modifications can be made to the present invention, apart from those shown or suggested herein, without departing from the scope and spirit of the present invention.

What is claimed is:

1. A system for incinerating fluid and solid waste, comprising:

a first combustion zone having an inlet for the introduction of fluid waste through a burner system and an outlet, a second combustion zone of a larger interior volume and diameter than the first combustion zone, the second combustion zone having an inlet for the introduction of emissions from the first combustion zone's outlet and an outlet, a third combustion zone of a larger interior volume and diameter than the second combustion zone, the third combustion zone having a first inlet for the introduction of emissions from the second combustion zone's outlet, a second inlet adjacent the first inlet for the introduction of solid waste, and an outlet opposite from the first and second inlets for discharge of gaseous and solid emissions, and means for introducing solid waste through the third combustion zone's second inlet, a portion of the introduction means being adapted to heat any solid waste therein from conduction and/or convection heat developed from the first and/or the second combustion zones.

2. The system of claim 1 wherein the second combustion zone includes an inlet for introduction of liquid and/or gaseous waste.

3. The system of claim 1 wherein the third combustion zone is a rotary kiln.

4. The system of claim 1 and including a post combustion chamber in communication with the outlet of the third combustion zone.

5. The system of claim 4 and including means for recycling a portion of the gaseous products of combustion from the post combustion chamber into the second combustion zone.

6. The system of claim 1 wherein the second combustion zone includes a plurality of nozzles.

7. The system of claim 1 wherein the introduction means comprises a conduit spaced adjacent to a lower portion of the second combustion zone.

8. The system of claim 7 and including plunger means for forcing solid waste through the conduit and into a lower portion of the third combustion zone.

9. The system of claim 6 wherein the second combustion zone comprises a circular wall member having a horizontal baffle dividing the wall member into two zones, the upper zone being for combustion of the liquid and/or gaseous waste, and the lower zone being the conduit for introduction of preheated solid waste into the third combustion zone.

10. The system of claim 1 wherein the second combustion zone includes fluid introduction means for controlling the temperature of combustion.

11. The system of claim 1 and including forced air sealing means between the second and the third combustion zones to pass air into the interior of the third combustion zones parallel with the flow of gases in the third combustion zone.

* * * * *